United States Patent [19]

Groelinger

[11] Patent Number: 4,929,471

[45] Date of Patent: May 29, 1990

[54] METHOD OF TREATING POLYESTER FABRIC

[75] Inventor: Howard Groelinger, Massapequa Park, N.Y.

[73] Assignee: The Balson-Hercules Group Ltd., Pawtucket, R.I.

[21] Appl. No.: 338,231

[22] Filed: Apr. 13, 1989

[51] Int. Cl.[5] ..... B05D 3/02; B05D 3/12

[52] U.S. Cl. ..... 427/173; 427/176; 427/381; 427/389.9; 427/393.1; 427/393.2; 428/265; 428/422

[58] Field of Search ..... 427/173, 176, 381, 389.9, 427/393.1, 392.3; 428/265, 422

[56] References Cited

U.S. PATENT DOCUMENTS 4,764,395 8/1988 Felder et al. ..... 427/54.1

*Primary Examiner*—Michael Lusignan

*Attorney, Agent, or Firm*—Salter & Michaelson

[57] ABSTRACT

A method of treating polyester fabric to enhance the physical properties thereof. The fabric is first exposed to a solution comprising a wetting agent, a nonionic fluorocarbon long chain polymer, a nonionic, cationic or anionic nonsilicone based softener, a gum and a carrier comprising water and/or an organic solvent. The fabric is then exposed to heat and tension to evaporate the carrier from the solution, polymerize the nonionic fluorocarbon long chain polymer, cross-link the polyester, the softener, the gum and the nonionic fluorocarbon long chain polymer and reorient the polyester to a more crystalized structure.

8 Claims, No Drawings

METHOD OF TREATING POLYESTER FABRIC

BACKGROUND AND SUMMARY OF THE INVENTION

The instant invention relates to the treatment of textiles and more particularly to a method of treating polyester fabrics to enhance the physical properties thereof.

While polyester fabrics have generally been found to be relatively inexpensive and durable fabrics, they have often been found to be unacceptable for many applications, such as for use in better quality garments. In this regard, most of the heretofore available polyester fabrics have generally been found to have a relatively cold hand and a relatively harsh feel and it has generally been found that they lack many of the aesthetic qualities of other fabrics such as rayon and silk. It has also been found that many polyester fabrics are difficult to sew and/or press and it has been found that it can be difficult to produce sharp creases in many polyester fabrics and/or to remove sharp creases therefrom. It has been further found that many polyester fabrics resist moisture absorption and that they have a tendency to cling due to static electricity build-up.

It has now been found that it is possible to process polyester fabrics so that they exhibit properties similar to those normally associated with silk and rayon. Specifically, it has been found that by treating a polyester fabric in a process wherein it is exposed to a treating solution comprising a wetting agent, a prespecified nonionic fluorocarbon long chain polymer, a softener, a gum and a carrier and wherein it is thereafter exposed to prespecified amounts of both heat and tension it is possible to significantly improve physical properties of the polyester fabric. More specifically, the treating solution utilized in the process of the subject invention comprises between 0.5% and 2% by weight of a conventional textile wetting agent, between approximately 4% and 16% by weight of a nonionic fluorocarbon long chain polymer, between approximately 1% and 6% by weight of a nonionic, cationic or anionic nonsilicone based softener, between approximately 1% and 10% by weight of a natural or synthetic gum and between approximately 66% and 93½% by weight of a carrier. The nonionic fluorocarbon long chain polymer comprises a copolymer of at least 25% by weight of a fluoroalkyl monomer and an alkylvinyl ether having the formula $CH_2{=}CH{-}OR$ wherein R represents a halogen substituted lower alkyl group. The carrier comprises water and/or a water soluble organic solvent, wherein the solvent is of a type which can be volatilized at a temperature below 360° F. without leaving a significant residue and also of a type which can be mixed with the nonionic fluorocarbon long chain polymer without reacting therewith. In accordance with the method, after a polyester fabric has been exposed to a treating solution of this type it is heated to a temperature sufficient to evaporate substantially all of the carrier therefrom, and it is then heated to a temperature of between 360° F. and 440° F. in order to effect curing of the fabric and the remaining components of the treating solution thereon. In addition, prior to, during and/or after heating the fabric to evaporate the carrier and/or to effect curing of the fabric and the remaining solution ccmponents thereon, it is exposed to both warpwise (longitudinal) and fillingwise (transverse) tension of between approximately 0.5 lbs per linear inch and 2 lbs. per linear inch. In the preferred form of the method the carrier comprises a water alchohol mixture and the polyester fabric is exposed to the treating solution by immersing it therein and thereafter passing it through a mangle. Specifically, the fabric is passed through a mangle to achieve a pick-up corresponding to an add-on of between approximately 1% and 6% of the weight of the fabric of the fluorocarbon long chain polymer, an add-on of between approximately 0.25% and 4% of the weight of the fabric of the softener and an add-on of between approximately 0.25% and 4% of the weight of the fabric of the gum. Further, the curing step is preferably effected by heating the fabric to a temperature of between approximately 360° F. and 440° F. for a period of up to 25 seconds and by immediately thereafter cooling the fabric to a temperature of less than approximately 300° F.

It has been found that fabrics treated in accordance with the method of the instant invention exhibit substantially improved physical properties. Specifically, it has been found that treated fabrics generally exhibit softer, rounder, smoother hand properties which are more similar to those normally associated with silk or rayon. It has also been found that fabrics treated in accordance with the method exhibit softer more homogenous light refraction properties which significantly improve their appearance characteristics. It has teen further found that they have improved water absorption properties and improved resistance to staining. In addition, it has been found that treated fabrics are generally more resistant to heat and resultant shrinkage during drying and ironing and that they are more receptive to ironing so that sharp creases can be readily produced therein or removed therefrom. Even further, it has been found that fabrics treated in accordance with the method have improved resistance to static electricity buildup and that they generally have less internal stresses from processing during manufacturing than untreated polyester fabrics so that they are generally capable of closer pattern identification. Even still further, it has been found that fabrics treated in accordance with the method can be more easily molded to prescribed patterns and that they have improved resistance to fraying.

Accordingly, it is a primary object of the instant invention to provide an effective method of treating polyester fabrics to improve the physical characteristics thereof.

Another object of the instant invention is to provide a method of treating polyester fabrics to make the physical properties thereof similar to those of silk and rayon.

An even further object of the instant invention is to provide an effective treated polyester fabric.

As this invention may be embodied in several forms without departing from the spirit or essential characteristics thereof, the present embodiment is therefore illustrative and not restrictive, since the scope of the invention is defined by the appended claims rather than by the description preceeding them, and all changes that fall within the metes and bounds of the claims or that form their functional as well as conjointly cooperative equivalents, are therefore intended to be embraced by these claims.

DESCRIPTION OF THE INVENTION

The instant invention provides an effective method of treating polyester fabric to enhance the physical properties thereof. In accordance with the method a sheet of polyester fabric is exposed to a predetermined carrier based chemical solution and thereafter the fabric is heated to evaporate the carrier components from the solution and to cure the fabric and the remaining solution components thereon. Further, prior to, during and/or after heating the fabric, it is exposed to predetermined levels of both longitudinal and transverse tension.

In accordance with the method of the subject invention a sheet of polyester fabric is treated by exposing it to a solution comprising between approximately 0.5% and 2% by weight of a wetting agent, 4% and 16% by weight of nonionic fluorocarbon long chain polymer, 1% and 6% by weight of nonionic, cationic or anionic nonsilicone based softener, 1% and 10% by weight of gum and 66% and 93½% by weight of a carrier. The nonionic fluorocarbon long chain polymer in the solution comprises a copolymer of at least 25% by weight of a fluoroalkyl monomer and an alkylvinyl ether having a formula of $CH_2{=}CH{-}OR$ wherein R represents a halogen substitute lower alkyl group. The carrier comprises water and/or an organic solvent of a type which can be volatilized at a temperature below 360° F. without leaving a significant residue and of a type which can be mixed with the nonionic fluorocarbon long chain polymer without reacting therewith. Specifically, the solvent preferably comprises a water soluble alcohol which can be mixed with the nonionic fluorocarbon long chain polymer without reacting therewith. The wetting agent preferably comprises a conventional textile wetting agent, such as isopropyl alcohol, although a variety of other known wetting agents can also be utilized in the solution applied by the method of the instant invention. The softener comprises a nonionic, cationic, or anionic nonsilicone based softener, such as DREWSOFT 100 made by E.F. Drew, Co., of Boonton, N.J., or EMERYSOFT 999 made by Emery Chemicals of Mauldin, S.C., although various other conventional fatty synthetic based derivative softeners can also be utilized. The gum preferably comprises a conventional natural or synthetic gum. For example, a natural gum such as gum arabic, gum trag, edible style gelatin, or guar gum or rosen soaps, or a synthetic gum, such as a polyethylene softener or gum thereof can be effectively utilized in accordance with the method.

In applying the method of the subject invention to a sheet of polyester fabric, the fabric is first exposed to a solution of the above described type. In particular, the fabric is preferably immersed in the solution and thereafter it is preferably passed through a conventional mangle. In this regard, the solution is preferably formulated and the mangle adjusted to achieve a "pickup" or percent add-on of between approximately 1% and 6% of the weight of the fabric of the fluorocarbon long chain polymer, between approximately 0.25% and 4% of the weight of the fabric of the softener and between approximately 0.25% and 4% of the weight of the fabric of the gum. After the polyester fabric has been exposed to the solution in this manner it is exposed to both heat and tension in order to evaporate the carrier, polymerize the nonionic fluorocarbon long chain polymer, cross-link the polyester, the softener, the gum and the fluorocarbon and reorient the polyester molecules to a more crystaline structure. More specifically, the polyester fabric with the solution thereon is heated to a temperature sufficient to evaporate substantially all of the carrier from the solution and thereafter the polyester fabric with the remaining solution components thereon is heated to a temperature of between 360° F. and 440° F. for a period of between 1 and 25 seconds to cure the remaining solution components and the fabric. In this regard, although the polyester fabric can be heated for a longer period of time, it has been found that prolonged exposure to high temperatures can cause many dyes commonly used in fabrics to be vaporized so that their respective fabrics loose all or part of their color characteristics and it has also been found that prolonged heating can cause over polymerization or charring of the residual solution components. Accordingly, the fabric is preferably cooled to a temperature of less than approximately 300° F. immediately after the heating step. In any event, prior to, during and/or after heating the fabric, the fabric is exposed to tension of between 0.5 lbs. per linear in. and 2.0 lbs. per linear in. in both longitudinal and transverse directions. Specifically, tension is preferably applied to the fabric utilizing any one of several types of conventional tension apparatus, such as a pin frame or a clip frame.

EXAMPLE

In a specific application of the method of the instant invention, a fabric consisting of 120 ends of 75 denier filament polyester and 75 picks of 100 denier texturized filament polyester was impregnated with a solution consisting of 8% by weight of nonionic fluorocarbon long chain polymer, 1% by weight of ATLAS 265 softener manufactured by Imperical Chemical Industries of Great Britain, 0.5% isopropyl alcohol (wetting agent), 3% by weight of guar gum and 87.5% by weight of water. In this regard, a 100 lb. solution of these chemicals was prepared by first heating 50 lbs. of the water to a temperature of between 75° F. and 80° F. and thereafter adding 0.5 lbs. of the isopropyl alcohol. This solution was then mixed with a conventional mixer operating at a speed of approximately 300 rpms and 3 lbs. of the guar gum, 1 lb. of the softener, 8 lbs. of the fluorocarbon long chain polymer and 37½ lbs. of water were slowly added to the water alcohol mixture as the entire solution was mixed with the mixer still operating at a speed of approximately 300 rpms. Polyester dry goods were then impregnated with the solution in a standard finishing mangle having an immersion bar thereon to ensure finishing out. The dry goods were squeezed through the mangle to get a 50% "pick-up" based on a 3 ton pressure setting on the mangle. The goods were then fed into a 3 zone clip frame where they were slowly heated while they were maintained under tension. Specifically, in the first zone of the clip frame the goods were heated to a temperature of approximately 300° F. for approximately 10 seconds in order to evaporate substantially all of the carrier therefrom. The goods were then passed to the second zone of the clip frame where they were heated to a temperature of approximately 380° F. and then to the third zone where they were heated to a temperature of approximately 405° F. The goods had a combined residence time in the second and third zones of approximately 20 seconds. Tension of approximately 0.75 lbs. per linear in. was applied to the fabric in both warpwise (longitudinal) and fillingwise (transverse) directions and the tension resulted in a 5% increase in the length of the finished goods. Immediately after the goods had been passed through the clip frame they were air cooled and then cooled further on a water cooled cylinder.

The polyester fabric treated in the above manner was found to have substantially improved physical characteristics as compared to untreated polyester fabrics.

Specifically, it was found that after the treated goods had been washed five times in a home style washing machine with 140° F. water they appeared to be identical to new goods. Further, the goods were effectively free from new creases and it was found that any wrinkles in the goods could be removed with a cool iron. It was further found that a hot iron did not stick to the treated fabric and that residual shrinkage was less than 0.5% in both warp and filling directions. The goods were also found to exhibit shrinkage of less than 1% after five ironings with a 400° F. hand iron. It was further found that normal wrinkles in the treated fabric would hang out by themselves.

In contrast to the above, it was found that untreated fabric of the same type was so wrinkled after one washing that it would normally be considered unusable. It was further found that residual shrinkage in untreated fabric after one washing was 3% warpwise and 3½% fillingwise and it was concluded that as a result, garments made with the untreated fabric would normally be unmerchantable. After five washings the untreated fabric was found to have shrinkage of 5½% warpwise and 5% fillingwise and it was found that the fabric had developed creases which could not be removed with a cool iron. Further, when an attempt was made to remove the creases with a 350° F. iron, additional shrinkage was encountered and the untreated fabric even puckered when exposed to a hot iron for more than five seconds.

It is seen therefore, that the instant invention provides an effective method of treating polyester fabrics. In this regard, it has been found that the method of the instant invention is operative for enhancing the physical properties of a polyester fabric by increasing the crystalinity thereof in a process wherein the fabric is exposed to a prespecified chemical solution as well as to heat and tension. Specifically, it has been found that when a polyester fabric consisting of filament or textured fibers is treated in accordance with the method of the subject invention the polyester molecules therein are converted from approximately 50% crystaline and 50% amorphous to approximately 75% crystaline and 25% amorphous. It has been further found that this substantially alters the physical properties of the fibers so that fabrics made therefrom have properties which are more similar to rayon and silk. Specifically, fabrics treated by the method of the subject invention have been found to have substantially improved hand characteristics and they have also been found to be more durable and capable of withstanding exposure to high temperatures without shrinking or puckering. In addition, fabrics treated by the method of the subject invention have been found to be more resistant to both pilling and fraying. Accordingly, it is seen that the method of the instant invention represents a significant advancement in the textile art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of treating a polyester fabric comprising the steps of:

a. exposing said fabric to a solution comprising between approximately 0.5% and 2% by weight of a wetting agent, 4% and 16% by weight of nonionic fluorocarbon long chain polymer, 1% and 6% by weight of nonionic, cationic or anionic nonsilicone based softener, 1% and 10% by weight of gum and 66% and 93½by weight of a carrier, the nonionic fluorocarbon long chain polymer comprising a copolymer of at least 25% by weight of a fluoroalkyl monomer and an alkylvinyl ether having the formula $CH_2{=}CH\text{-}OR$ wherein R represents a halogen substituted lower alkyl group, the carrier being selected from a group consisting of water, water plus a water soluble organic solvent, and a water soluble organic solvent wherein the water soluble organic solvent is of a type which can be volatilized at a temperature below 360° F. without leaving a significant residue and also of a type which can be mixed with the nonionic fluorocarbon long chain. polymer without reacting therewith;

b. heating said fabric to a temperature sufficient to evaporate substantially all of the carrier thereon;

c. heating said fabric from which the carrier has been evaporated to a temperature of between 360° F. and 440° F. to effect curing of said fabric and the remaining components of said solution thereon; and d. applying between approximately 0.5 lbs. per linear in. and 2.0 lbs. per linear in. of tension to said fabric in both longitudinal and transverse directions.

2. In the method of claim 1, said exposing step further characterized as exposing said fabric to said solution to achieve a pick up corresponding to a percent add-on of between approximately 1% and 6% of the weight of said fabric of said fluorocarbon long chain polymer, between approximately 0.25% and 4% of the weight of said fabric of said softener and between approximately 0.25% and 4% of the weight of said fabric of said gum.

3. In the method of claim 2, said exposing step further characterized as comprising the steps of:

a. immersing said fabric in said solution; and b. passing said fabric through a mangle.

4. In the method of claim 1, said solvent further characterized as an alcohol.

5. In the method of claim 1, said heating step further characterized as heating said fabric to a temperature of between approximately 360° F. and 440° F. for a period of between 1 and 25 seconds, said method further comprising the step of cooling said fabric to a temperature of less than approximately 350° F. immediately after said heating step.

6. A polyester fabric treated by the method of claim 1.

7. A polyester fabric treated by the method of claim 2.

8. A polyester fabric treated by the method of claim 5.

* * * * *